US012023562B2

(12) United States Patent
Parmeter

(10) Patent No.: US 12,023,562 B2
(45) Date of Patent: Jul. 2, 2024

(54) RING TOSSING GAME AND GAME APPARATUS

(71) Applicant: Eric Parmeter, Tannersville, PA (US)

(72) Inventor: Eric Parmeter, Tannersville, PA (US)

( * ) Notice: Subject to any disclaimer, the term of this patent is extended or adjusted under 35 U.S.C. 154(b) by 349 days.

(21) Appl. No.: 17/366,255

(22) Filed: Jul. 2, 2021

(65) Prior Publication Data

US 2021/0331054 A1 Oct. 28, 2021

Related U.S. Application Data

(63) Continuation-in-part of application No. 16/513,333, filed on Jul. 16, 2019, now Pat. No. 11,083,943.

(51) Int. Cl.
*A63B 21/04* (2006.01)
*A63B 67/06* (2006.01)

(52) U.S. Cl.
CPC ..... *A63B 67/06* (2013.01); *A63B 2067/063* (2013.01)

(58) Field of Classification Search
None
See application file for complete search history.

(56) References Cited

U.S. PATENT DOCUMENTS 145,914 A * 12/1873 Smith ..... A63B 67/06 273/338
411,221 A * 9/1889 Gooch ..... A63B 67/06 273/338
659,352 A * 10/1900 Park ..... F41J 3/0047 273/348.5
731,192 A * 6/1903 Lewis ..... A63B 67/06 273/338
939,580 A * 11/1909 Young ..... A63B 67/06 273/338
1,501,942 A * 7/1924 Carman ..... A63B 67/06 273/339
1,557,788 A * 10/1925 Atkin ..... A63F 9/0208 273/338
4,045,028 A * 8/1977 Dyess ..... A63B 67/06 273/338
4,120,499 A * 10/1978 Stazzone ..... A63B 67/06 273/338
4,198,048 A * 4/1980 Rathert ..... A63B 67/06 273/339
D288,828 S * 3/1987 Romestan ..... D21/309
(Continued)

FOREIGN PATENT DOCUMENTS

CA 1048566 2/1979

*Primary Examiner* — Sunit Pandya
(74) *Attorney, Agent, or Firm* — James R. McDaniel

(57) ABSTRACT

A game of skill which consists of rings being tossed at one or more targets and more particularly to the construction of the equipment including the targets and rings for use in such a game, and a method of play, more particularly, to a ring toss game. Nine pegs are formed into a rectangular pattern having three columns and are attached onto the target, wherein the rectangular pattern includes four corners with four of the pegs located at each of the corners. A plurality of corner circles is located on the base, wherein one of the four corner pegs is located within one of the plurality of corner circles. A plurality of horizontal, vertical and diagonal lines is located on the base.

2 Claims, 3 Drawing Sheets

(56) References Cited

U.S. PATENT DOCUMENTS

| | | | | |
|---|---|---|---|---|
| 6,135,455 | A * | 10/2000 | McNally | A63B 67/06 273/338 |
| 6,241,251 | B1 * | 6/2001 | Trifonov | A63B 67/06 273/339 |
| 2010/0176554 | A1 * | 7/2010 | Godwin | A63B 67/06 273/338 |

* cited by examiner

RING TOSSING GAME AND GAME APPARATUS

CROSS-REFERENCE TO RELATED APPLICATION

This application is a continuation-in-part of U.S. patent application Ser. No. 16/513,333, filed on Jul. 16, 2019, the disclosure of which is hereby incorporated by reference in its entirety to provide continuity of disclosure to the extent such a disclosure is not inconsistent with the disclosure herein.

BACKGROUND OF THE INVENTION

Field of the Invention

The present invention relates to a game of skill which consists of rings being tossed at one or more targets and more particularly to the construction of the equipment including the targets and rings for use in such game, and a method of play, more particularly, to a ring toss game.

Description of the Prior Art

U.S. Design Pat. No. D478,357 issued Aug. 12, 2003 to Thomas A. Penna, discloses an ornamental design for a ring toss game utilizing rings which have a determined point value and two pegs which are inserted into a playing field.

U.S. Design Pat. No. D462,092 issued Aug. 27, 2002 to Brian Temple, discloses an ornamental design for a ring toss game utilizing targets which have three open holes vertically aligned to receive circular rings shown.

U.S. Design Pat. No. 257,745 issued Dec. 30, 1980 to Adolph Abraham, discloses an ornamental design for a ring toss game target which consists of three pegs attached to the top of the target in a triangular arrangement.

U.S. Pat. No. 10,166,451 issued Jan. 1, 2019 to Randolph G. Laskowitz, discloses a ring toss game consisting of a perpendicular object tube in the center of first square tray which rings may be tossed in a game of skill.

U.S. Pat. No. 7,802,795 issued Sep. 28, 2010 to Daniel M. Bos, discloses a portable horseshoe game suitable for use in connection with an existing bags game.

U.S. Pat. No. 4,198,048 issued Apr. 15, 1980 to Larry F. Rathert, discloses a ring toss game consisting of a base which is cruciform in shape and embedded in the ground, with at least one peg angled toward the center of the base.

U.S. Pat. No. 4,045,028 issued Aug. 30, 1977 to Lonnie V. Dyess, discloses a game target with adjustable pins with the game boards fitting together for compact storage and transportation. Presently, none of the above inventions and patents, taken either singly or in combination, is seen to describe this instance of the invention as claimed.

SUMMARY OF THE INVENTION

An equipment system consisting of multiple targets and rings, the manner in which the equipment system is produced, and method of play which will allow for play of a ring toss game.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION

Preferably, the target base 2 will be approximately 34" in length and 22" in width.

Preferably, each target base 2 will also include nine pegs 1 that will be approximately 5" in length from top to bottom with an approximate circumference of one and one-fourth inches.

Preferably, the nine pegs 1 will attach into or to a top side or a bottom side (FIG. 7) of the target base in both three columns and three rows.

Preferably, this will consist of a middle column of three pegs 1 which are all ten inches from the side of the target base 2 width-wise, with two columns of three pegs 1 each on both sides of the middle column six inches apart.

Preferably, three pegs 1 will make up a middle row approximately 17" from the bottom of the target base's 2 top, with two rows of three pegs 1 each both 9" above and below the middle row.

Preferably, both the bottom row of three pegs 1 and the top row of three pegs 1 will be 8" from both the bottom and top of the target base 2, respectively.

Figure 6:
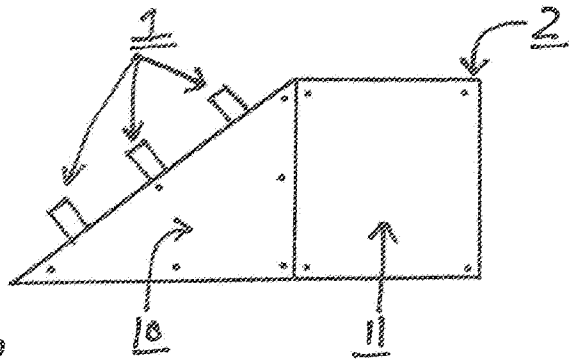
FIG. 6—Back/Left view of target, peg, and an alternative support structure, according to a fourth embodiment.
Figure 5:
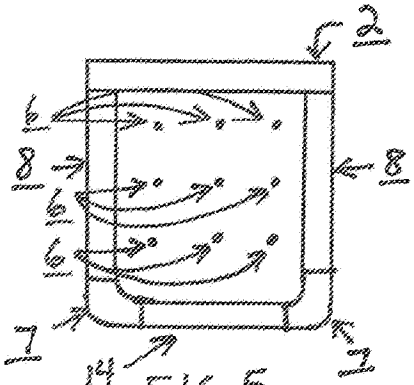
FIG. 5—Back view of target, peg components for attachment to target, alternative supporting legs, and alternative components for supporting legs, according to a third embodiment.
Figure 7:
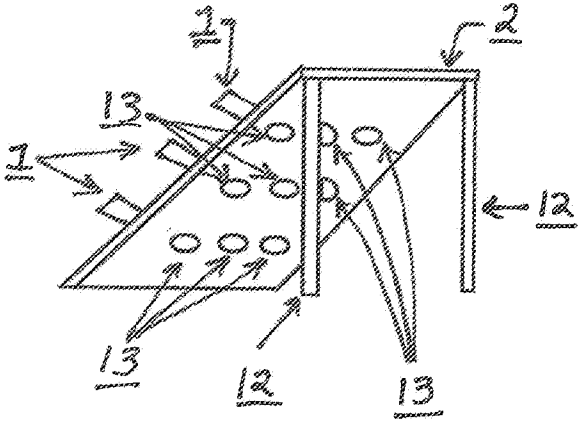
FIG. 7—Back/Left view of target, pegs, alternative supporting legs, and an alternative peg insertion element, according to a fifth embodiment.
Figure 4:
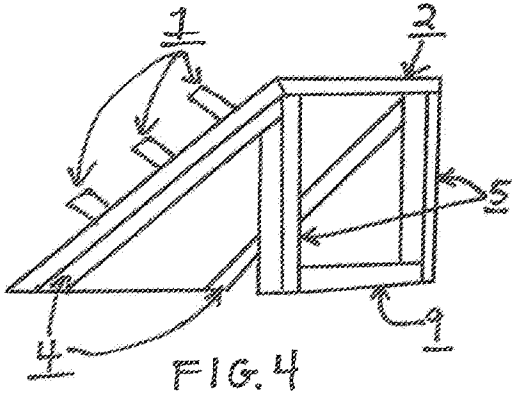
FIG. 4—Back/Left view of target, pegs, and components for supporting legs, according to a second embodiment.

Preferably, the target base 2 will be approximately half inch in thickness, with two supporting legs 12, one in each corner of the back of the target base 2, approximately 22¾" in length. In another embodiment, leg supports 4 and 9 can be used to support legs 5 (FIG. 4). As shown in FIG. 5, leg supports 8 can be used to support legs 7 and 14. As shown in FIG. 6, in a still another embodiment, leg supports 10 and 11 can be used to support target base 2. Finally, as shown in FIG. 7, in a still further embodiment, legs 12 can be placed in leg insertion openings 13 located on the bottom of target base 2.

Figure 3:
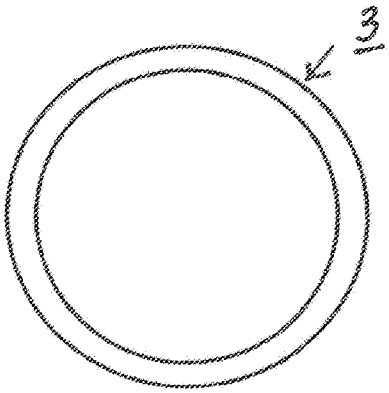
FIG. 3—Top view of ring.
Figure 2:
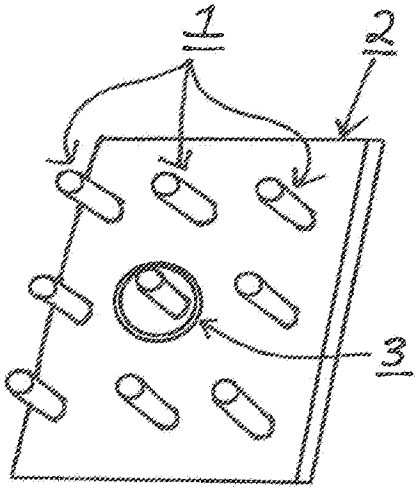
FIG. 2—Front/Right view of target for ring toss game, pegs, and ring, according to a first embodiment.
Figure 1:
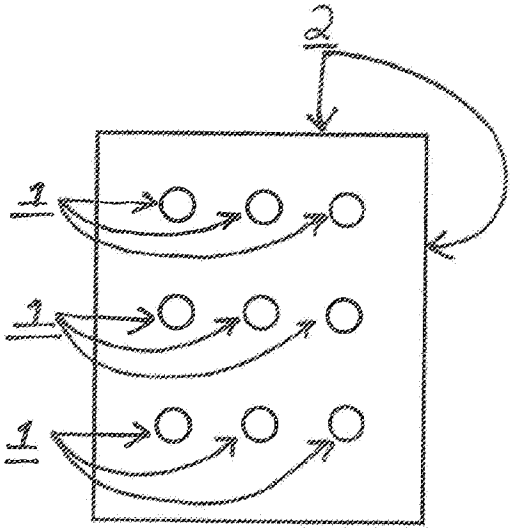
FIG. 1—Front view of target for ring toss game and pegs.

Preferably, there will be eight (8) rings 3 in total (FIG. 3), four used by each player or team that will be approximately 6" in diameter and 1¼" in circumference.

Preferably, the fronts of each target base 2 will face each other and have a distance of nine feet between the target bases 2 when measured from the bottom of each target base 2, with players or team members not crossing the closest point of target base 2 to toss rings to the opposite target 2.

Preferably, when a ring 3 is thrown over a peg 1 and the peg 1 penetrates the center of the ring 3 thereby causing the ring 3 to remain around it, it will be counted as a score.

Preferably, the top row of three pegs 1 will count for three points each, the middle row of three pegs 1 will count for two points each, and the bottom row of three pegs 1 will count for one point each.

Preferably, if during a player or teams' turn their three rings 3 are thrown around three different pegs 1 on the target base 2 in a row, either horizontally, vertically, or diagonally, the player or team will double the points scored.

Preferably, if during a player or team's turn their four rings 3 are thrown around the four corner pegs 1 on the area of target base 2, the team will automatically win the game.

Preferably, each time a player or team tosses their ring 3 onto the same peg 1 that the opposite player or team has scored points on, the scored points will cancel out.

Preferably, when beginning the game to determine the order of tossing, each team will choose one player.

Preferably, all four rings 3 will be tossed by the player chosen for each team, adding the total points scored without using the ability to cancel scored points, with the highest point scoring team tossing first to begin the game.

Figure 8:
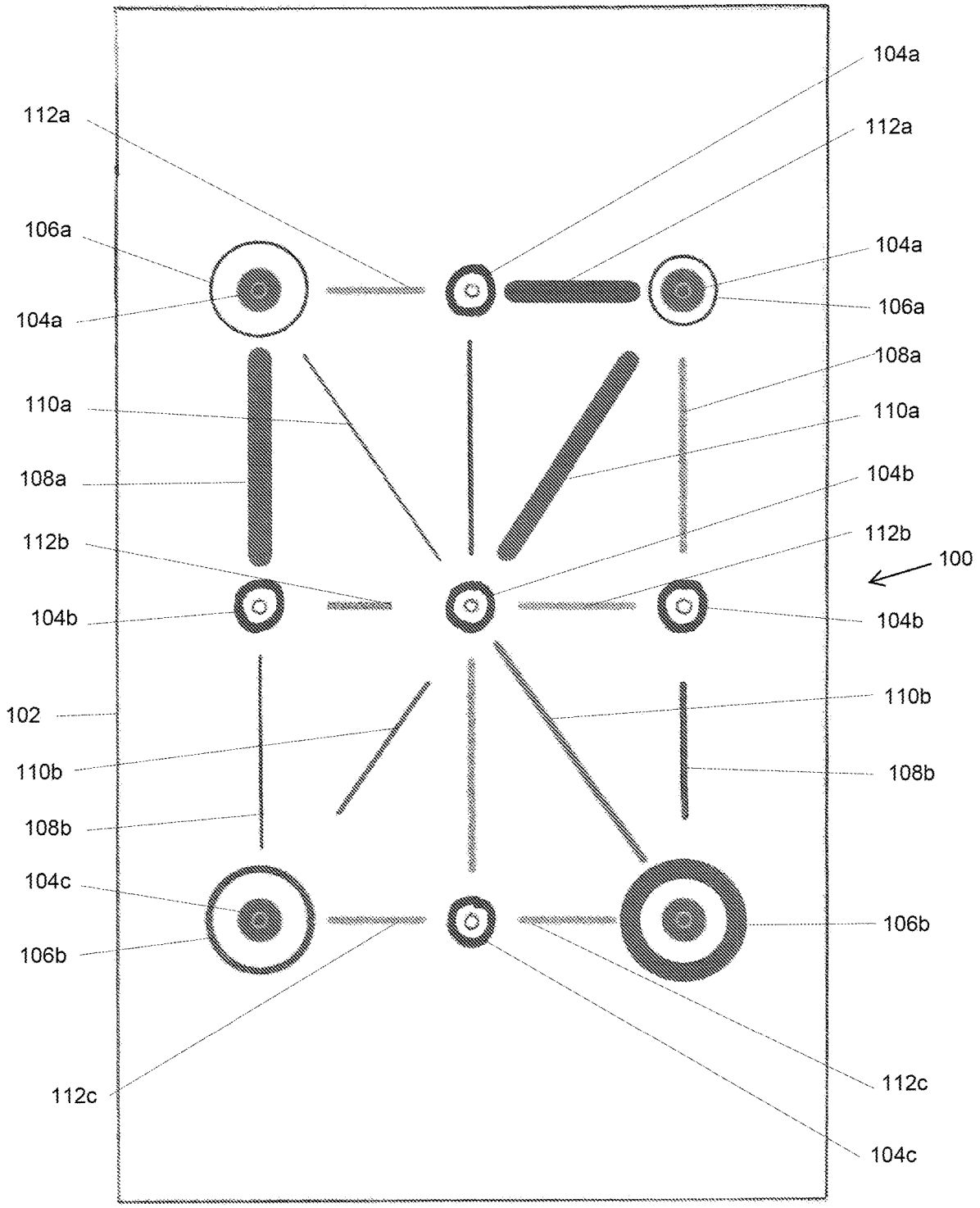
FIG. 8 is a schematic, isometric view of another embodiment of the target.

With respect to FIG. 8, there is illustrated another embodiment of the target 100. It is to be understood that target 100 can be constructed in a similar manner as target base 2. Also, target 100 can also be supported in a similar manner as target base 2 as shown in FIGS. 4-7. Target 100 includes, in part, target base 102, pegs 104*a*-104*c*, corner circles 106*a*-106*b*, vertical lines 108*a* and 108*b*, diagonal lines 110*a* and 110*b*, and horizontal lines 112*a*-112*c*.

A unique aspect of the present invention is the use of corner circles 106*a* and 106*b*. As shown in FIG. 8, corner circles 106*a*-106*b* are located at the corners of the grid formed by the nine pegs 104*a*-104*c*. In particular, two (2) of the pegs 104*a* are each located within one of the corner circles 106*a* and two (2) of the pegs 104*c* are each located within one of the corner circles 106*b*. The other peg 104*a* is located between the corner circles 106*a* and the other peg 104*c* is located between the corner circles 106*b*.

Another unique aspect of the present invention is that pegs 104*b* are located between pegs 104*a* and 104*c*.

A still further unique aspect of the present invention is vertical lines 108*a* which are located between corner circles 106*a* and pegs 104*b* and between pegs 104*a* and 104*b* and vertical lines 108*b* which are located between corner circles 106*b* and pegs 104*b* and between pegs 104*b* and 104*c*. Also, diagonal lines 110*a* are located between corner circles 106*a* and pegs 104*b* and diagonal lines 110*b* are located between corner circles 106*b* and pegs 104*b*. Finally, horizontal lines 112*a* are located between corner circles 106*a* and peg 104*a*, horizontal lines 112*b* are located between pegs 104*b*, and horizontal lines 112*c* are located between corner circles 106*b* and peg 104*c*.

An even further unique aspect of the present invention is that the vertical lines 108*a* and 108*b*, diagonal lines 110*a* and 110*b*, and horizontal lines 112*a*-112*c* can be constructed of any suitable line thickness and/or color. Also, corner circles 106*a* and 106*b* can also be constructed of any suitable line thickness and/or color. The key importance being that the corner circles 106*a* and 106*b* which are located around pegs 104*a* and 104*c*, respectively, should include some type of colored line thickness, as will be discussed in greater detail later. It is to be understood that while various elements of the present invention should be colored, the selection of the color, for example, the corner circles 106*a* and 106*b* and the vertical lines 108*a* and 108*b*, diagonal lines 110*a* and 110*b*, and horizontal lines 112*a*-112*c* is a matter of design choice.

Using the Target 100

It is to be understood that the target 100 can used in a similar manner as target base 2. However, the following additional set of rules can also be utilized in relation to target 100.

Preferably, the fronts of each target 100 will face each other and have a distance of nine feet between the targets 100 when measured from the bottom of each target 100, with players or team members not crossing the closest point of target 100 to toss rings 3 to the opposite target 100.

Preferably, when a ring 3 is thrown over a peg 104*a*-104*c* and the peg 104*a*-104*c* penetrates the center of the ring 3, thereby causing the ring 3 to remain around it, it will be counted as a score.

If necessary, declaring the first or second player a winner when first or second players' tallied points, based on ring(s) 3 remaining penetrated by the peg(s) 104*a*-104*c* at end of a turn, equals the designated game total which is used to declare the first or second player a winner such as, for example, playing to exactly a point total of 21.

If necessary, tallying different points based on the throws by the first and second player if the ring 3 remains penetrated by any of the bottom three horizontal pegs 104*c*, middle horizontal pegs 104*b*, or top horizontal pegs 104*a*, at the end of a turn by the first and second player such as discussed above in that the top row of three pegs 104*a* will count for three points each, the middle row of three pegs 104*b* will count for two points each, and the bottom row of three pegs 104*c* will count for one point each.

If necessary, tallying different points based on the throws by the first and second player if multiple rings 3 remain penetrated by the pegs 104*a*-104*c* in a horizontal, vertical, or diagonal manner. For example, three rings 3 remaining penetrated by a peg 104*a* in a row doubles the amount of tallied points for each of the designated rings 3 that remains penetrated by each peg 104*a* at the end of a turn by the first and second player. This rule can be referred to as doubling points based on three in a row horizontal, vertical, or diagonal.

If necessary, tallying different points based on the throws by the first and second player if multiple rings 3 remain penetrated by the same peg 104*a*. For example, three rings 3 remaining penetrated by a single peg 104*a* (for example) doubles the amount of tallied points for each of the designated rings 3 that remains penetrated by the peg 104*a* at the end of a turn by the first and second player. This rule can be referred to as doubling points based on three rings 3 around a single peg such as peg 104*a*.

If necessary, immediately declaring the first or second player a winner based on the throws by the first or second player if the plurality of rings 3 remain penetrated by the pegs 104*a* and 104*c* located within the four corner circles 106*a* and 106*b* on the target 100 and remain around the four corner pegs 104*a* and 104*c*, regardless of opponent canceling rings. As discussed above, the corner circles 106*a* and 106*b* should include a line thickness and a color that will draw the player's attention to try to throw the rings 3 towards the four corner circles 106*a* and 106*b* so that the rings 3 become penetrated by the pegs 104*a* and 104*c* and remain around the four corner pegs 104*a* and 104*c*, regardless of opponent canceling rings.

If necessary, only tallying points at the end of the turn based on the throws by the first and second player if the points do not go over the designated game total which is used to declare the first or second player a winner. For example, if the point total goes over 21 points, the points do not count for that turn.

If necessary, first and second player will begin at the point total which either started at beginning of turn if ring(s) 3 remaining around peg(s) 104*a*-104*c* at the end of a turn would go over the designated game total which is used to declare the first or second player a winner. For example, the player's score goes over 21, that player's score will return to the score that that player started with at the beginning of that player's turn.

If necessary, at the beginning of a game to determine who of the first or second player throws first during gameplay, both the first and second player will alternate throwing rings 3 until all rings are thrown, tallying all points to and designating the first player to throw at the beginning of the game as the player with the highest total scored. Under this rule, cancellation of points is not used.

If necessary, declaring the first or second player a winner when first or second players' tallied points based on ring(s) 3 remaining penetrated by the peg(s) 104*a*-104*c* at end of a turn equals zero based on subtracting points from designated beginning total used to declare the first or second player a winner. For example, the players start at some designated number such as 21 and subtract points earned from the designated score until a player reaches zero (0) points.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

What is claimed is:

1. A ring toss game set, comprising:

at least one rectangular target having a base with a length and width which can lay flat or have at least one supporting element to increase a rear height of the target;

nine pegs formed into a rectangular pattern having three columns and three rows, with each peg having a top end, a bottom end, and a length such that the bottom end attaches into or to a front surface of the target, wherein the rectangular pattern includes four corners with four of the pegs located at each of the corners;

a plurality of annular tossing elements for peg penetration through a center of each of the plurality of annular tossing elements;

a plurality of corner circles located on the base and wherein each one of the four corner pegs is located within each one of the plurality of corner circles, wherein each of the plurality of corner circles includes a line thickness and a color that will draw a player's attention to try to throw the each of the plurality of annular tossing elements towards the four corner circles, and wherein the player is declared a winner based on the throws by the player if the plurality of rings thrown by the player remain penetrated by the four corner pegs and remain around the four corner pegs without another player's ring(s) remaining penetrated by any of each of the four corner pegs; and a plurality of horizontal, vertical and diagonal lines located on the base and wherein at least one of the plurality of horizontal lines is located between at least one of the plurality of corner circles and one of the nine pegs, at least one of the plurality of vertical lines is located between at least one of the plurality of corner circles and one of the nine pegs, and at least one of the plurality of diagonal lines is located between at least one of the plurality of corner circles and one of the nine pegs.

2. A method of constructing a ring toss game, comprising the steps of:

providing at least one rectangular target having a base with a length and width which can lay flat or have at least one supporting element to increase a rear height of the target;

attaching nine pegs to the at least one rectangular target, wherein the pegs are formed into a rectangular pattern having three columns and three rows, with each peg having a top end, a bottom end, and a length such that the bottom end attaches into or to a front surface of the target, wherein the rectangular pattern includes four corners with four of the pegs located at each of the corners;

providing a plurality of annular tossing elements for peg penetration through a center of each of the plurality of annular tossing elements;

attaching a plurality of corner circles on the base, wherein each one of the four corner pegs is located within each one of the plurality of corner circles, wherein each of the plurality of corner circles includes a line thickness and a color that will draw a player's attention to try to throw the each of the plurality of annular tossing elements towards the four corner circles, and wherein the Player is declared a winner based on the throws by the player if the plurality of rings thrown by the player remain penetrated by the four corner pegs and remain around the four corner pegs without another player's ring(s) remaining penetrated by any of each of the four corner pegs; and attaching a plurality of horizontal, vertical and diagonal lines on the base, wherein at least one of the plurality of horizontal lines is located between at least one of the plurality of corner circles and one of the nine pegs, at least one of the plurality of vertical lines is located between at least one of the plurality of corner circles and one of the nine pegs, and at least one of the plurality of diagonal lines is located between at least one of the plurality of corner circles and one of the nine pegs.

* * * * *